US008622501B2

(12) United States Patent
Komamiya et al.

(10) Patent No.: US 8,622,501 B2
(45) Date of Patent: Jan. 7, 2014

(54) INKJET PRINTER AND INKJET PRINTING METHOD

(75) Inventors: Eiji Komamiya, Kawasaki (JP); Mitsutoshi Nagamura, Tokyo (JP); Akihiro Tomida, Kawasaki (JP); Shingo Nishioka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/179,686

(22) Filed: Jul. 11, 2011

(65) Prior Publication Data

US 2012/0013664 A1 Jan. 19, 2012

(30) Foreign Application Priority Data

Jul. 15, 2010 (JP) ..... 2010-160998

(51) Int. Cl.
*B41J 29/38* (2006.01)

(52) U.S. Cl.
USPC ..... 347/14

(58) Field of Classification Search
USPC ..... 347/12, 14
See application file for complete search history.

(56) References Cited

U.S. PATENT DOCUMENTS 6,155,663 A * 12/2000 Takayanagi ..... 347/5
6,557,964 B2 * 5/2003 Kawatoko et al. ..... 347/15
7,789,476 B2 9/2010 Tomida et al.
7,980,652 B2 7/2011 Baba et al.

FOREIGN PATENT DOCUMENTS

JP 2001-180017 A 7/2001

* cited by examiner

*Primary Examiner* — Julian Huffman
(74) *Attorney, Agent, or Firm* — Fitzpatrick, Cella, Harper & Scinto

(57) ABSTRACT

In an inkjet printer that prints an image by a forward scan and a backward scan of printing heads, it is determined whether or not a color unevenness occurrence value set on the basis of values of unit image data constituting image data is more than a predetermined threshold value. If the color unevenness occurrence value is less than the threshold value, data that enable a dot to be formed in a unit area corresponding to the unit image data by the forward scan and the backward scan of the printing heads are generated. If the color unevenness occurrence value is more than the threshold value, data that enable a dot to be formed in the unit area only by one of the forward scan and the backward scan of the printing heads are generated.

12 Claims, 13 Drawing Sheets

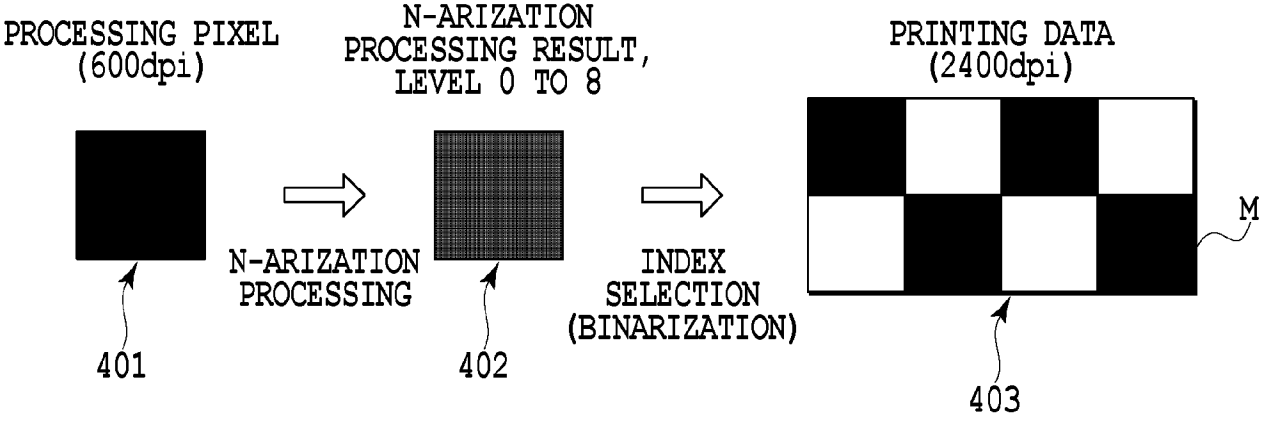
FIG.4A
FIG.4B
FIG.4C
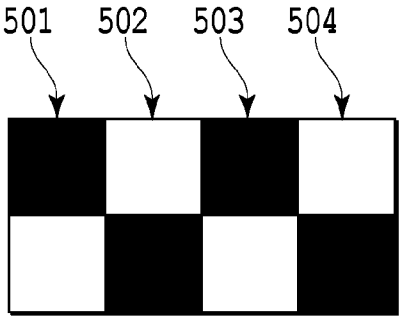
FIG.5

RGB MULTI-VALUE
(600dpi)
601

C, M, Y, K
PIXEL INPUT VALUES
(600dpi)
602

N-ARIZATION
PROCESSING RESULT,
LEVEL 0 TO 5
603

PRINTING DATA
(2400dpi)
1 2 3 4
5 6 7 8
M
604

PRINT RESULT
(1200dpi)
A B
C D
605

FIG.9A

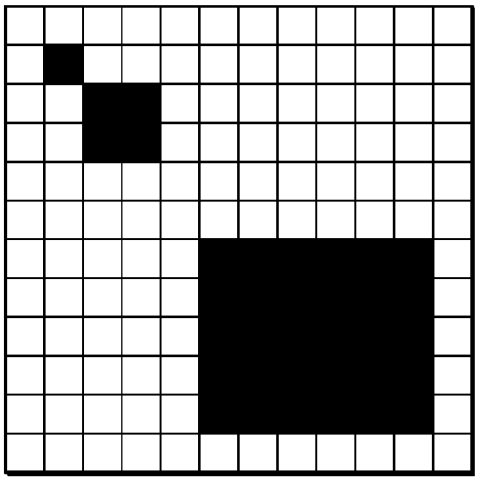

□ THRESHOLD VALUE S > K

■ THRESHOLD VALUE S ≦ K

FIG.9B

| | | | | | | | | | | | |
|---|---|---|---|---|---|---|---|---|---|---|---|
| A | A | A | A | A | A | A | A | A | A | A | A |
| A | B | A | A | A | A | A | A | A | A | A | A |
| A | A | B | B | A | A | A | A | A | A | A | A |
| A | A | B | B | A | A | A | A | A | A | A | A |
| A | A | A | A | A | A | A | A | A | A | A | A |
| A | A | A | A | A | A | A | A | A | A | A | A |
| A | A | A | A | A | B | B | B | B | B | A | A |
| A | A | A | A | A | B | B | B | B | B | A | A |
| A | A | A | A | A | B | B | B | B | B | A | A |
| A | A | A | A | A | B | B | B | B | B | A | A |
| A | A | A | A | A | B | B | B | B | B | A | A |
| A | A | A | A | A | A | A | A | A | A | A | A |

A: INDEX PATTERN DATA A ARE SELECTED

B: INDEX PATTERN DATA B ARE SELECTED

FIG.9C

| | | | | | | | | | | | |
|---|---|---|---|---|---|---|---|---|---|---|---|
| ○ | ○ | ○ | ○ | ○ | ○ | ○ | ○ | ○ | ○ | ○ | ○ |
| ○ | × | ○ | ○ | ○ | ○ | ○ | ○ | ○ | ○ | ○ | ○ |
| ○ | ○ | × | × | ○ | ○ | ○ | ○ | ○ | ○ | ○ | ○ |
| ○ | ○ | × | × | ○ | ○ | ○ | ○ | ○ | ○ | ○ | ○ |
| ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | ○ | ○ | ○ | ○ | ○ | ○ | ○ |

○: PRINTING IN FORWARD AND BACKWARD DIRECTIONS

×: PRINTING ONLY IN FORWARD DIRECTION

| | | | | | | | | | | | |
|---|---|---|---|---|---|---|---|---|---|---|---|
| 1,2 | 1,2 | 1,2 | 1,2 | 1,2 | 1,2 | 1,2 | 1,2 | 1,2 | 1,2 | 1,2 | 1,2 |
| 1,2 | 1 | 1,2 | 1,2 | 1,2 | 1,2 | 1,2 | 1,2 | 1,2 | 1,2 | 1,2 | 1,2 |
| 1,2 | 1,2 | 1 | 1 | 1,2 | 1,2 | 1,2 | 1,2 | 1,2 | 1,2 | 1,2 | 1,2 |
| 1,2 | 1,2 | 1 | 1 | 1,2 | 1,2 | 1,2 | 1,2 | 1,2 | 1,2 | 1,2 | 1,2 |
| 1,2 | 1,2 | 1,2 | 1,2 | 1,2 | 1,2 | 1,2 | 1,2 | 1,2 | 1,2 | 1,2 | 1,2 |
| 1,2 | 1,2 | 1,2 | 1,2 | 1,2 | 1,2 | 1,2 | 1,2 | 1,2 | 1,2 | 1,2 | 1,2 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 2,3 | 2,3 | 2,3 | 2,3 | 2,3 | 2,3 | 2,3 |

FIG.12A

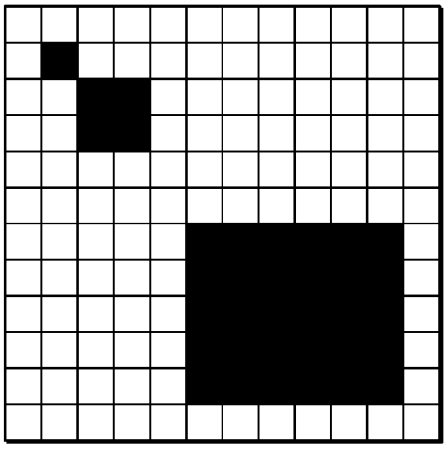

□ THRESHOLD VALUE S > K

■ THRESHOLD VALUE S ≦ K

FIG.12B

| | | | | | | | | | | | |
|---|---|---|---|---|---|---|---|---|---|---|---|
| 1 | 3 | 2 | 4 | 3 | 4 | 1 | 3 | 2 | 4 | 3 | 4 |
| 2 | 1 | 4 | 3 | 1 | 2 | 2 | 1 | 4 | 3 | 1 | 2 |
| 4 | 3 | 4 | 1 | 3 | 2 | 4 | 3 | 4 | 1 | 3 | 2 |
| 3 | 1 | 2 | 2 | 1 | 4 | 3 | 1 | 2 | 2 | 1 | 4 |
| 1 | 3 | 2 | 4 | 3 | 4 | 1 | 3 | 2 | 4 | 3 | 4 |
| 2 | 1 | 4 | 3 | 1 | 2 | 2 | 1 | 4 | 3 | 1 | 2 |
| 4 | 3 | 4 | 1 | 3 | 2 | 4 | 3 | 4 | 1 | 3 | 2 |
| 3 | 1 | 2 | 2 | 1 | 4 | 3 | 1 | 2 | 2 | 1 | 4 |
| 1 | 3 | 2 | 4 | 3 | 4 | 1 | 3 | 2 | 4 | 3 | 4 |
| 2 | 1 | 4 | 3 | 1 | 2 | 2 | 1 | 4 | 3 | 1 | 2 |
| 4 | 3 | 4 | 1 | 3 | 2 | 4 | 3 | 4 | 1 | 3 | 2 |
| 3 | 1 | 2 | 2 | 1 | 4 | 3 | 1 | 2 | 2 | 1 | 4 |

1: INDEX PATTERN DATA SET 1 IS SELECTED
2: INDEX PATTERN DATA SET 2 IS SELECTED
3: INDEX PATTERN DATA SET 3 IS SELECTED
4: INDEX PATTERN DATA SET 4 IS SELECTED

FIG.12C

| | | | | | | | | | | | |
|---|---|---|---|---|---|---|---|---|---|---|---|
| 1A | 3A | 2A | 4A | 3A | 4A | 1A | 3A | 2A | 4A | 3A | 4A |
| 2A | 1B | 4A | 3A | 1A | 2A | 2A | 1A | 4A | 3A | 1A | 2A |
| 4A | 3A | 4B | 1B | 3A | 2A | 4A | 3A | 4A | 1A | 3A | 2A |
| 3A | 1A | 2B | 2B | 1A | 4A | 3A | 1A | 2A | 2A | 1A | 4A |
| 1A | 3A | 2A | 4A | 3A | 4A | 1A | 3A | 2A | 4A | 3A | 4A |
| 2A | 1A | 4A | 3A | 1A | 2A | 2A | 1A | 4A | 3A | 1A | 2A |
| 4A | 3A | 4A | 1A | 3A | 2B | 4B | 3B | 4B | 1B | 3A | 2A |
| 3A | 1A | 2A | 2A | 1A | 4B | 3B | 1B | 2B | 2B | 1A | 4A |
| 1A | 3A | 2A | 4A | 3A | 4B | 1B | 3B | 2B | 4B | 3A | 4A |
| 2A | 1A | 4A | 3A | 1A | 2B | 2B | 1B | 4B | 3B | 1A | 2A |
| 4A | 3A | 4A | 1A | 3A | 2B | 4B | 3B | 4B | 1B | 3A | 2A |
| 3A | 1A | 2A | 2A | 1A | 4A | 3A | 1A | 2A | 2A | 1A | 4A |

1A: INDEX PATTERN DATA 1A
1B: INDEX PATTERN DATA 1B
2A: INDEX PATTERN DATA 2A
2B: INDEX PATTERN DATA 2B
3A: INDEX PATTERN DATA 3A
3B: INDEX PATTERN DATA 3B
4A: INDEX PATTERN DATA 4A
4B: INDEX PATTERN DATA 4B

FIG.12D

| | | | | | | | | | | | |
|---|---|---|---|---|---|---|---|---|---|---|---|
| ○ | ○ | ○ | ○ | ○ | ○ | ○ | ○ | ○ | ○ | ○ | ○ |
| ○ | × | ○ | ○ | ○ | ○ | ○ | ○ | ○ | ○ | ○ | ○ |
| ○ | ○ | × | × | ○ | ○ | ○ | ○ | ○ | ○ | ○ | ○ |
| ○ | ○ | × | × | ○ | ○ | ○ | ○ | ○ | ○ | ○ | ○ |
| ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | × | × | × | × | × | ○ | ○ |
| ○ | ○ | ○ | ○ | ○ | ○ | ○ | ○ | ○ | ○ | ○ | ○ |

○: PRINTING IN FORWARD AND BACKWARD DIRECTIONS

×: PRINTING ONLY IN FORWARD DIRECTION

| | | | | | | | | | | | |
|---|---|---|---|---|---|---|---|---|---|---|---|
| 1,2 | 1,2 | 1,2 | 1,2 | 1,2 | 1,2 | 1,2 | 1,2 | 1,2 | 1,2 | 1,2 | 1,2 |
| 1,2 | 1 | 1,2 | 1,2 | 1,2 | 1,2 | 1,2 | 1,2 | 1,2 | 1,2 | 1,2 | 1,2 |
| 1,2 | 1,2 | 1 | 1 | 1,2 | 1,2 | 1,2 | 1,2 | 1,2 | 1,2 | 1,2 | 1,2 |
| 1,2 | 1,2 | 1 | 1 | 1,2 | 1,2 | 1,2 | 1,2 | 1,2 | 1,2 | 1,2 | 1,2 |
| 1,2 | 1,2 | 1,2 | 1,2 | 1,2 | 1,2 | 1,2 | 1,2 | 1,2 | 1,2 | 1,2 | 1,2 |
| 1,2 | 1,2 | 1,2 | 1,2 | 1,2 | 1,2 | 1,2 | 1,2 | 1,2 | 1,2 | 1,2 | 1,2 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 3 | 3 | 3 | 3 | 3 | 2,3 | 2,3 |
| 2,3 | 2,3 | 2,3 | 2,3 | 2,3 | 2,3 | 2,3 | 2,3 | 2,3 | 2,3 | 2,3 | 2,3 |

INKJET PRINTER AND INKJET PRINTING METHOD

BACKGROUND OF THE INVENTION

1. Field of the Invention

The present invention relates to an inkjet printer and inkjet printing method that, while scanning a printing head, ejects printing liquid such as ink on a printing medium to print an image. More particularly, the present invention relates to an inkjet printer and inkjet printing method that enables, in both forward and backward scans of a printing head, the image to be printed.

2. Description of the Related Art

Currently, a serial type inkjet printer is widely used, that is provided with: a carriage mounted with a printing head including a plurality of nozzles that eject ink and an ink tank; a conveyance unit that conveys a printing medium; and a control unit that controls them. The inkjet printer repeatedly performs: a main scan in which, while moving the carriage in a direction (main scanning direction) orthogonal to a conveyance direction of the printing medium, the ink is ejected from the printing head to perform printing; and a sub scan in which, at the time of printing, the printing medium is conveyed by a distance corresponding to the printing width of the printing head. Also, many of the currently used inkjet printers are ones that can use a plurality of color inks to print full color images. For example, printing heads that can eject inks such as yellow (Y), magenta (M), cyan (c), and black (b) inks are mounted on a carriage, and these inks are used to print full color images. In many cases, in the carriage, a plurality of printing heads corresponding to the respective inks are sequentially arranged along the main scanning direction.

In the case where along a forward direction in the main scan, the printing heads are arrayed in the order of Bk, C, M, and Y, a printing order at the time of printing on a printing medium by a forward scan is the order of Bk, C, M, and Y, whereas a printing order at the time of printing by a backward scan is the order of Y, M, C, and Bk. As described, the printing order is different between the forward and backward scans and, therefore, the order to overlap the inks on the printing medium is different between the forward printing and the backward printing. For this reason, the hue is different depending on the conveyance distance of the printing medium, which may cause color unevenness to result in a reduction in image quality.

A document that discloses the technique for preventing color unevenness in so-called bidirectional printing in which the forward printing and backward printing are performed is Japanese Patent Laid-Open No. 2001-180017. Japanese Patent Laid-Open No. 2001-180017 discloses a printing method that counts the number of dots for each ink color on the basis of printing data, and if an ink driving threshold where color unevenness occurs is exceeded, it fixes the printing direction to a forward or backward direction. If the printing direction is fixed to perform printing as described, the printing order of respective inks becomes constant and, therefore, color unevenness can be suppressed.

However, in the technique disclosed in Japanese Patent Laid-Open No. 2001-180017, if the ink driving threshold where color unevenness occurs is exceeded, the printing direction is fixed to the forward or backward direction and, therefore, there arises a problem in that the printing time is increased.

SUMMARY OF THE INVENTION

The present invention is intended to provide an inkjet printer and inkjet printing method that can reduce the occurrence of color unevenness in bidirectional printing and also suppress an increase in printing time.

In order to accomplish the above objective, the present invention has the following configuration. That is, a first aspect of the present invention is an inkjet printer that moves a plurality of printing heads capable of ejecting different inks along a predetermined main backward and forward scanning direction, and on a basis of printing data specifying ejection or non-ejection of the inks, controls ejection of the inks from the respective printing heads to print an image on a printing medium, the inkjet printer comprising: a printing data generation unit that generates the printing data on a basis of image data; and a determination unit that determines whether or not a color unevenness occurrence value set on the basis of values of unit image data constituting the image data is more than a predetermined threshold value, the color unevenness occurrence value relating to a degree of occurrence of color unevenness, wherein if the color unevenness occurrence value is less than the threshold values, the printing data generation unit enables a dot to be formed in a unit area corresponding to the unit image data by a forward scan and a backward scan by the printing heads, whereas if the color unevenness occurrence value is more than the threshold value, the printing data generation unit enables a dot to be formed in the unit area only by any one of the forward scan and the backward scan by the printing heads.

A second aspect of the present invention is an inkjet printing method that moves a plurality of printing heads capable of ejecting different inks along a predetermined main backward and forward scanning direction and on the basis of printing data specifying ejection or non-ejection of the inks, controls ejection of the inks from the respective printing heads to print an image on a printing medium, the inkjet printing method comprising: a printing data generation step of generating the printing data on the basis of image data; and a determination step of determining whether or not a color unevenness occurrence value set on the basis of values of unit image data constituting the image data is equal to or more than a predetermined threshold value, wherein if the color unevenness occurrence value is less than the threshold values, the printing data generation step enables a dot to be formed in a unit area corresponding to the unit image data by a forward scan and a backward scan by the printing heads, whereas if the color unevenness occurrence value is more than the threshold value, the printing data generation step enables a dot to be formed in the unit area only by any one of the forward scan and the backward scan by the printing heads.

According to the present invention, while performing printing operation based on the forward and backward scans of the printing heads, the occurrence of color unevenness can be reduced and the increase in printing time can be suppressed.

Further features of the present invention will become apparent form the following description of exemplary embodiments (with reference to the attached drawings).

BRIEF DESCRIPTION OF THE DRAWINGS

FIGS. 4A to 4C are diagrams schematically illustrating an outline of printing data generation processing in the first embodiment;

FIG. 5 is a diagram schematically illustrating an example of the two-column thinning method performed in the first embodiment;

FIG. 9A to 9E are schematic diagrams for describing data processing, and printing operation according to the first embodiment;

FIGS. 12A to 12F are schematic diagrams of data processing, and printing operation according to the second embodiment.

DESCRIPTION OF THE EMBODIMENTS

One embodiment of the present invention is described below in detail with reference to the drawings.

Figure 1:
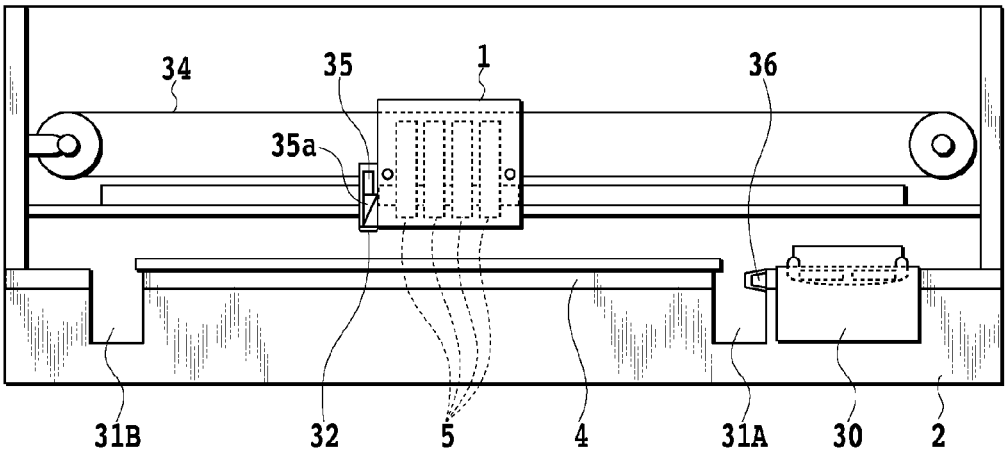
FIG. 1 is a plan view of an inkjet printer in the first embodiment.

FIG. 1 is a plan view of an inkjet printer (hereinafter also simply referred to as a printer) in the present embodiment. The inkjet printer illustrated here is one that performs printing on a relatively large-sized printing medium and is provided with a printer main body 2 including a conveyance unit that is not illustrated that conveys the printing medium in a Y direction (conveyance direction). The main body 2 is provided with a moveable carriage 1 that is attached in the main scanning direction along a guide shaft 33. The carriage 1 is configured to be movable forward and backward along the main scanning direction (X direction) by a driving force that is transmitted from a carriage motor (not illustrated) through a belt 34. The carriage 1 is mounted with a plurality of printing heads 5 each having a plurality of nozzles that eject ink droplets, and the printing heads 5 move in the main scanning direction together with the carriage 1. Also, the carriage 1 is provided with an optical sensor 32. The optical sensor 32 detects the presence or absence of the printing medium on a platen while moving in the main scanning direction together with the carriage 1. Also, the inkjet printer of the present embodiment is provided with an ejection failure nozzle sensing unit 36 that can sense ejection failure of each of the nozzles of the printing heads and has a floodlight part and a light-receiving part. Specifically, by sensing the presence or absence of an ink droplet that blocks the light path from the floodlight part to the light-receiving part, the ejection failure of each of the nozzles is detected.

Also, in order to keep ejection performance of each of the nozzles of the printing heads 5 in a proper state, the inkjet printer is provided with a printing head recovery unit. The recovery unit is configured to have a suction recovery mechanism 30 that covers an ejection port formed at the tip of each of the nozzles of the printing heads 5 with a cap connected to a pump, and on the basis of negative pressure generated inside the cap by the pump, sucks and discharges viscous ink or the like inside the nozzle.

Figure 2:
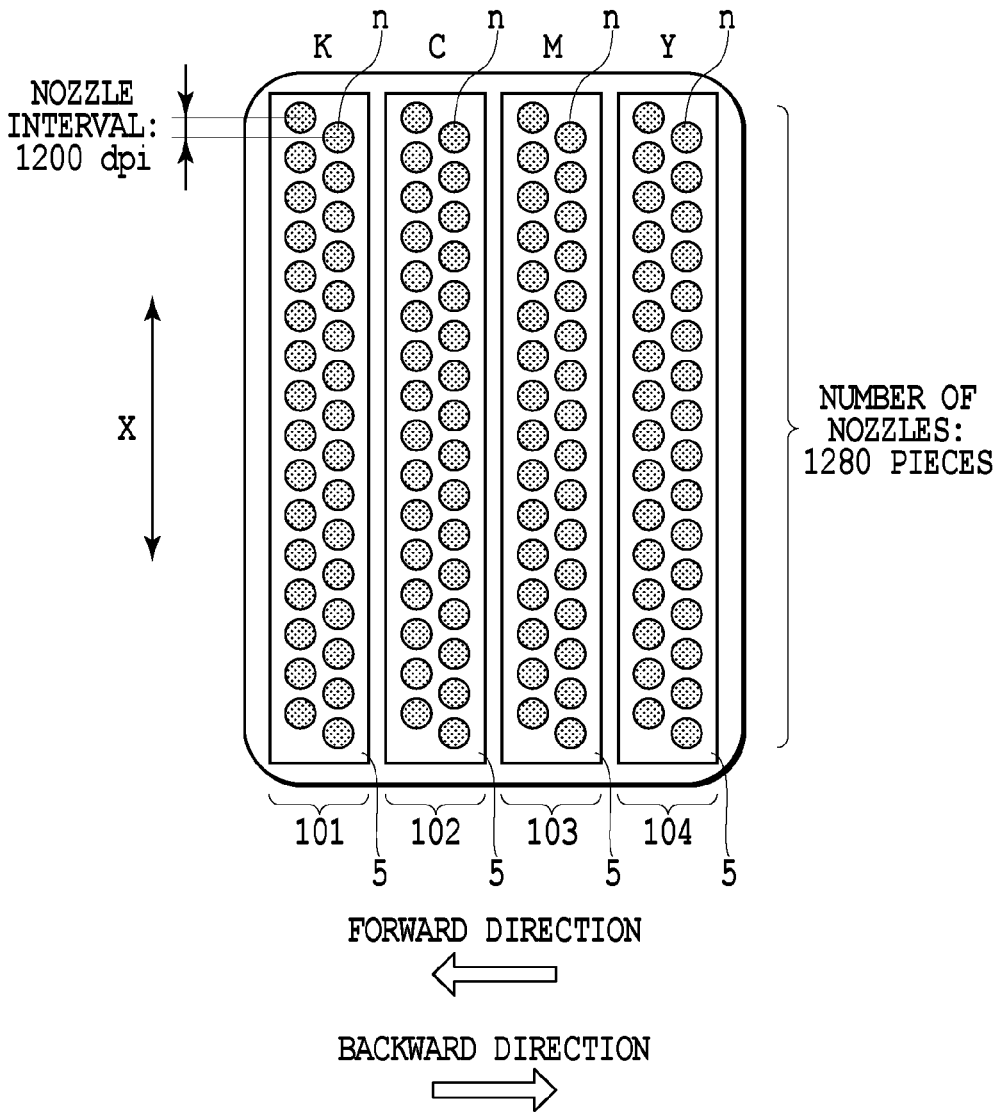
FIG. 2 is a plan view schematically illustrating an array of ejection ports of printing heads used in the first embodiment.

FIG. 2 is a plan view schematically illustrating an array of ejection ports of the printing heads used in the embodiment of the present invention. Each of the printing heads 5 illustrated here is provided with a plurality of nozzles that eject ink. Each of the nozzles includes the ejection port n that ejects ink, and an ink flow path (not illustrated) communicatively connected to the ejection port n, and inside the ink flow path of each of the nozzles, there is provided an electrothermal transducer that locally heats ink to give rise to film boiling, and on the basis of corresponding foaming energy, ejects the ink. In each of the printing heads, an ejection port array corresponding to each of the plurality of color inks to be used is arranged. In each of the ejection port array of the present embodiment, there are 1280 ejection ports that are arrayed at a density of 1200 dpi along a sub scanning direction corresponding to the conveyance direction of the printing medium.

The printing heads in the present embodiment are configured to be so-called horizontally arranged heads in which, in order to enable a full color image to be printed, the ejection port arrays 101 to 104 that eject black (Bk), cyan (C), magenta (M), and yellow (Y) inks are sequentially arranged along the X direction. In addition, from the nozzle arrays 101, 102, 103, and 104, the Bk, C, M, and Y inks are respectively ejected.

In the inkjet printer configured as described, the printing medium is conveyed in the sub scanning direction from the conveyance unit that is not illustrated. The printing heads 5 receive a printing signal from the printing control unit that is not illustrated, and while moving in the main scanning direction together with the carriage 1, eject the inks toward a printing area of the printing medium. By repeating such a printing operation and conveying operation that conveys the printing medium in the sub scanning direction by a predetermined amount, printing is performed. That is, by scanning the printing heads, an image is printed.

Figure 3:
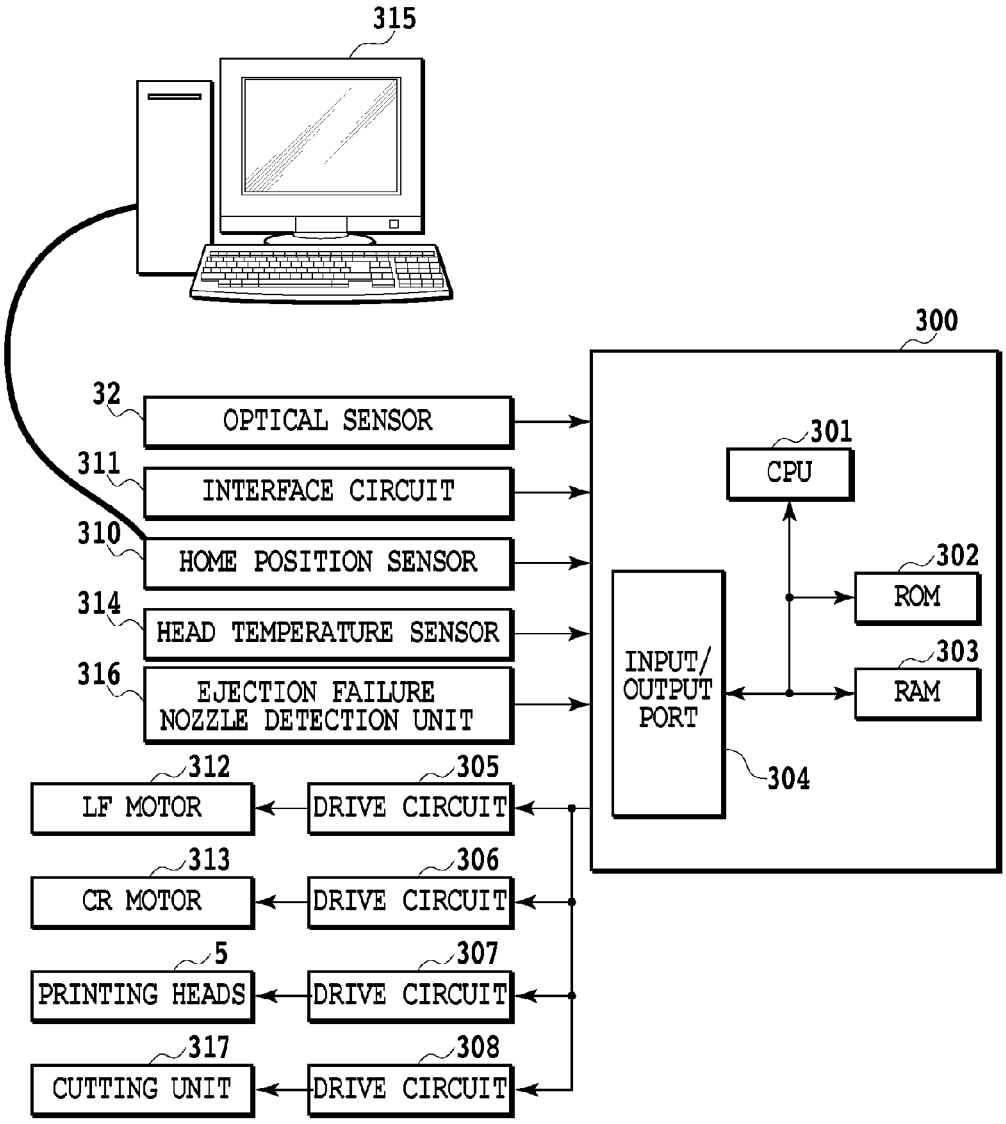
FIG. 3 is a block diagram illustrating a schematic configuration of a control system in the first embodiment.

FIG. 3 is a block diagram illustrating a schematic configuration of a control system in the present embodiment. A main control unit 300 is provided with: a CPU 301 that performs processing operation such as calculation, selection, determination, or control; an ROM 302 that stores a control program, and the like, to be executed by the CPU 301; an RAM 303 that is used as a buffer for printing data, or the like; an input/output port 304, and the like. In addition, the CPU functions as a first selection unit and a second selection unit that perform an after-mentioned selection step. Also, the input/output port 304 is connected with respective drive circuits 305, 306, 307, and 308 such as actuators or the like in a conveying motor (LF motor) 312, carriage motor (CR motor) 313, printing heads 5, and cutting unit 317. Further, the input/output port 304 is connected with various types of sensors. For example, a head temperature sensor 314 that detects the temperature of each of the printing heads, a home position sensor 310 that detects that the carriage 1 is at a home position where the recovery operation of each of the printing heads is performed, an ejection failure nozzle detection unit that examines an ejection state of each of the printing heads 5, and the like are connected. Further, the main control unit 300 is connected to a host computer 315 through an interface circuit 311.

The printing operation performed by the inkjet printer having the above configuration is described.

In the present embodiment, after-mentioned dot arrangement pattern data (also referred to as index pattern data) are used to convert multi-value input image data to binary data (printing data) representing whether or not a dot is formed, i.e., ejection or non-ejection of an ink droplet in each of the printing heads. In this binarization processing, for example, in the host device, the image data are quantized to have a relatively low resolution, and the quantized multi-value image data are transferred to the printer main body. In the printer main body, the received image data are converted to the binary data (printing data) with the use of the index pattern data, and the binary data are expanded in the buffer.

FIGS. 4A to 4C are diagrams schematically illustrating an outline of processing steps from when the printer main body receives the multi-value input data to when it generates the printing data. In FIGS. 4A to 4C, the input image data received from the host computer 315 are converted to pixel data 401 (FIG. 4A) that are internally processed to have a resolution of 600 dpi. Note that the term "pixel data" here means multi-value image data (unit image data) for giving the inks to a pixel that is a minimum unit area for an image to be printed, and the pixel data at this step have a level from 0 to 256 steps. Then, the quantization processing is performed to convert the pixel data 401 to pixel data 402 (FIG. 4B) having a 9-step level from 0 to 8. Subsequently, on the basis of predetermined index pattern data, to a matrix M (unit area) having vertically 2 areas×horizontally 4 areas illustrated in FIG. 4C, the binary data (printing data) 403 representing whether or not a dot is formed are allocated. Note that, in the following description, in the printing data, data representing the formation of a dot, i.e., data for ejecting ink droplets are particularly referred to as dot data. FIG. 4C illustrates the case where the pixel data are 4-value data, and within the matrix M, four types of dot data are allocated. By performing the processing based on the index pattern data (hereinafter referred to as index processing), binarized data having resolutions of horizontally 2400 dpi and vertically 1200 dpi can be generated as the printing data. The above is the outline of the printing data generation processing steps.

When the main control unit 300 receives the above printing data, the CPU 301 controls, on the basis of a program stored in the ROM 302, data stored in the RAM 303, and the like, driving of the respective motors, printing heads, and the like through the input/output port 304 to perform the printing operation. As the printing operation, in order to speedup the driving speed of the carriage 1, there is a printing method that prints an image within an area printable on the basis of one printing scan by the printing heads with the one printing scan being divided into a plurality of printing scans. This printing method is referred to as a divided printing method. A printing technique in the present embodiment is realized by using the divided printing method and the above-described printing data generating method. In the following, the printing technique in the present embodiment is described in more detail by citing a specific example.

The divided printing method in the present embodiment employs a two-column thinning method that decreases the printing resolution in each printing scan and prints only specific column data in each printing scan.

FIG. 5 is a diagram schematically illustrating an example of the two-column thinning method performed in the present embodiment. In the two-column thinning method, printing data are divided into odd-numbered column data and even-numbered column data, and printing scans based on the odd-numbered column data and printing scans based on the even-numbered column data are sequentially repeated. Accordingly, column data to be used by each printing scan are uniquely determined. In the case of performing printing on the basis of four types of column data 501, 502, 503, and 504 that are, in printing data in a matrix (unit area) having vertically 4 areas×horizontally 2 areas illustrated in FIG. 5, sequentially allocated from the leftmost toward the right in the diagram, each column is printed as follows. That is, in the case of printing dots in both forward and backward directions, i.e., performing so-called bidirectional printing scans on the basis of the two-column thinning method, the odd-numbered column data (501 and 503) are used in a printing scan in the forward direction (hereinafter referred to as a forward scan). Also, the even-numbered column data (502 and 504) are used in a printing scan in the backward direction (hereinafter referred to as a backward scan).

Figures 6A, 6B, 6C, 6D, 6E:
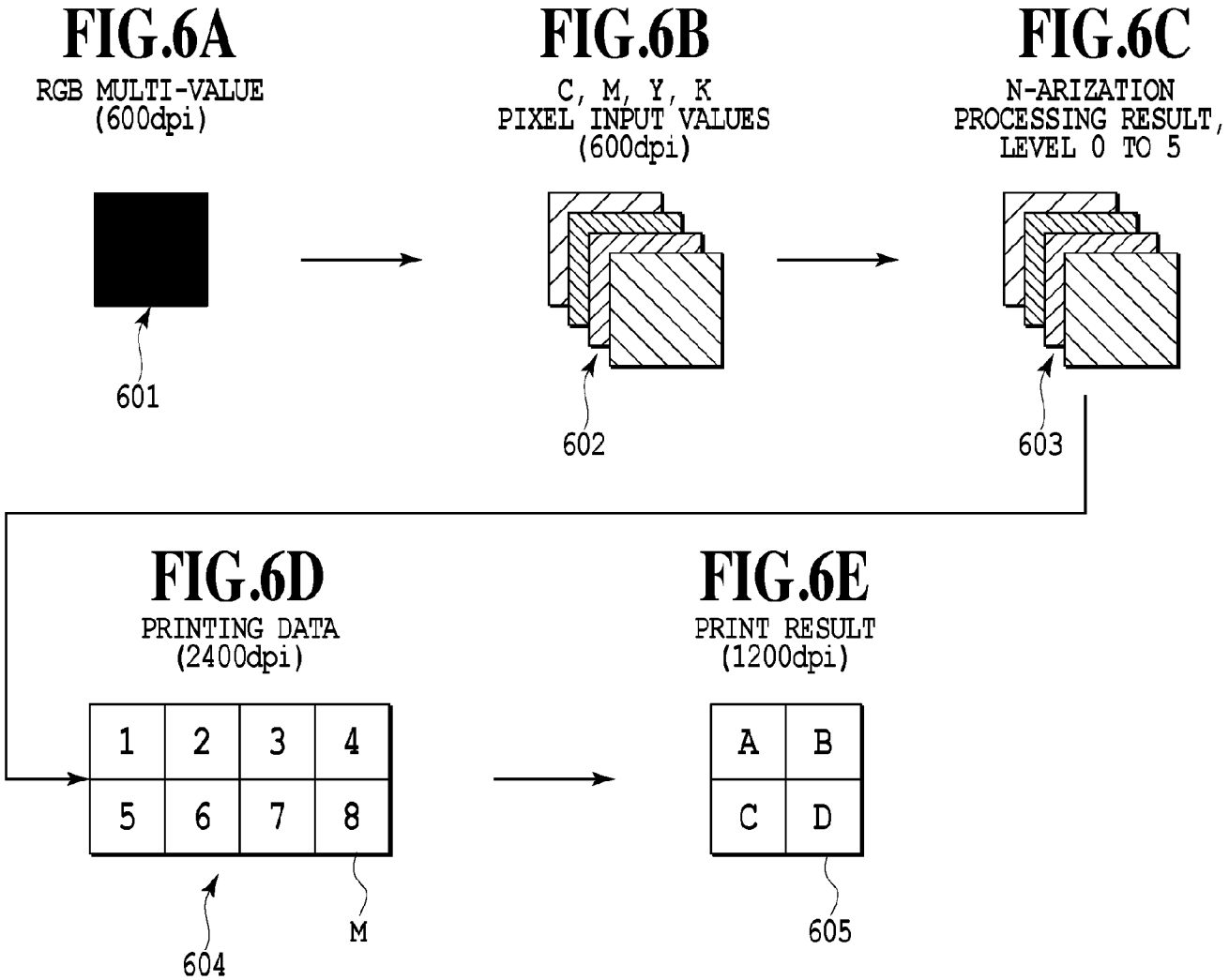
FIGS. 6A to 6E are schematic diagrams for describing a printing data generating procedure in the first embodiment.

FIGS. 6A to 6E are schematic diagrams for describing a printing data generating procedure in the present embodiment. Inputted R, G, B multi-value pixel data are processed to be pixel data 601 having a resolution of 600 dpi (FIG. 6A). Then, the R, G, B multi-value (8 bits: 0 to 255) input pixel data are converted to C, M, Y, Bk multi-value (8 bits: 0 to 255) pixel data 602 (FIG. 6B). After that, the C, M, Y, Bk multi-value pixel data are converted to 5-level (0 to 4) C, M, Y, Bk pixel data (FIG. 6C) by the quantization processing. Subsequently, on the basis of the level of each of the pixel data having been subjected to the quantization processing, after-mentioned index pattern data are referenced to generate dot data to be allocated within a matrix M having horizontally 4 areas and vertically 2 areas illustrated in FIG. 6D.

Considering the above-described two-column thinning method and area positions to which the dot data are allocated within the matrix M, dot data expanded in areas indicated by numerals 1, 3, 5, and 7 described in the matrix M serve as data used in the printing scan in the forward direction. On the other hand, dot data expanded in areas indicated by numerals 2, 4, 6, and 8 described in the matrix M serve as data used in the printing scan in the backward direction.

Dot landing positions for the case of actually performing printing on the basis of the above-described binary printing data are illustrated in the printing result 605 of FIG. 6E. The printing resolution is 1200 dpi and, therefore, an ink droplet ejected on the basis of binary printing data expanded in the area 1 and 2 in the matrix M lands on the landing position A. Similarly, an ink droplet ejected on the basis of dot data expanded in the area 3 and 4 lands on the landing position B. Further, an ink droplet ejected on the basis of dot data expanded in the area 5 and 6 lands on the landing position C. Also, an ink droplet ejected on the basis of dot data expanded in the area 7 and 8 lands on the landing position D.

Considering the characteristics of the two-column thinning method and the ink droplet landing positions, on the basis of printing data having a resolution of horizontally 2400 dpi, and printing an image at a printing resolution of horizontally 1200 dpi, it is only necessary to land one ink droplet in each of the landing positions A, B, C, and D. That is, it is only necessary to perform printing on the basis of pixel data allocated to any one of the areas 1 and 2, areas 3 and 4, areas 5 and 6, and areas 7 and 8 in the matrix M. Also, the pixel data allocated to the areas 1, 3, 5, and 7 are used for the printing scan in the forward direction, whereas the data allocated to the areas 2, 4, 6, and 8 are used for the printing scan in the backward direction. Note that, in the present embodiment, an example employing the above-described two-column thinning method is described; however, the present invention is not limited to this but is only required to fix fixed-data thinning processing and a print scanning direction.

Next, color unevenness suppression control performed by the present embodiment is described. The color unevenness suppression control is control to suppress color unevenness occurring in an image by selecting a printing direction on the basis of inputted pixel data. In the following, with reference to the drawings, the description is provided.

Figure 7A:
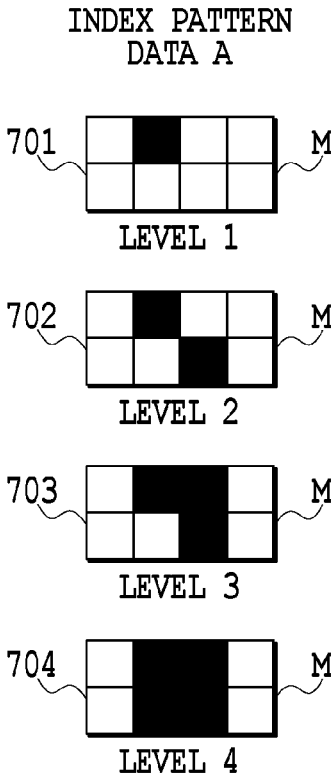
FIGS. 7A and 7B are schematic diagrams illustrating dot arrangement pattern data used in the first embodiment.
Figure 7B:
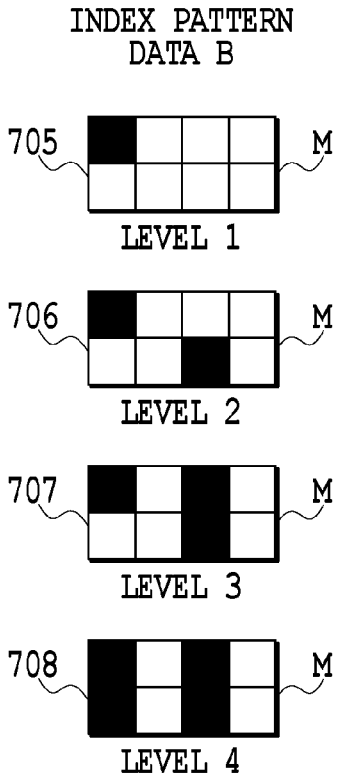

FIGS. 7A and 7B are schematic diagrams illustrating two types of dot arrangement pattern data used in the present embodiment. Levels 1 to 4 indicated in FIGS. 7A and 7B represent levels of pixel data having been subjected to the quantization processing. Index pattern data A (first dot arrangement pattern data) illustrated in FIG. 7A include four types of pattern data 701 to 704 each in which dot data are allocated within a matrix M having horizontally 4 areas and vertically 2 areas. Also, index pattern data B (second dot arrangement pattern data) illustrated in FIG. 7B include four types of pattern data 705 to 708 each in which dot data are allocated within the matrix M having horizontally 4 areas and vertically 2 areas. The four types of pattern data 701 to 704 of the index pattern data A of one type respectively correspond to the levels 1 to 4, and the four types of pattern data 705 to 708 of the second index pattern data B respectively correspond to the levels 1 to 4. In this case, in the level 1, one dot datum is allocated within the matrix M; in the level 2, two dot data are allocated within the matrix M; in the level 3, three dot data are allocated within the matrix M; and in the level 4, four dot data are allocated within the matrix M. Note that the number of level steps of the pixel data having been subjected to the quantization processing is, as described above, five from 0 to four, and in the level 0, no dot datum is allocated within the matrix M.

In the index pattern data A illustrated in FIG. 7A, in the matrices 701 to 704, dot data are allocated to the odd-numbered and even numbered areas 2, 3, 6, and 7 (see the matrix M in FIG. 6D) and, therefore, dots are printed in each of the forward and backward scans. That is, in the level 1, as illustrated in the matrix 701, the dot datum is allocated to the area 2 (see the matrix M in FIG. 6D) and, therefore, according to the dot datum, a dot is printed by the backward scan. Also, in the level 2, as illustrated in the matrix 702, the dot data are allocated to the areas 2 and 7 and, therefore, according to the dot data, dots are printed by the forward and backward scans. In the level 3, as illustrated in the matrix 703, the dot data are allocated to the pixel generation positions 2, 3, and 7 and, therefore, according to the dot data, dots are printed by the forward and backward scans. Further, in the level 4, as illustrated in the matrix 704, the dot data are allocated to the pixel generation positions 2, 3, 6, and 7 and, therefore, according to the dot data, dots are printed by the forward and backward scans.

On the other hand, in the index pattern data B illustrated in FIG. 7B, dot data are allocated to the areas 1, 3, 5, and 7 (see the matrix M in FIG. 6D) in the matrices 705 to 708 and, therefore, dots are printed only by the forward scan. That is, in the level 1, as illustrated in the matrix 705, the dot datum is allocated to the area 1, and in the level 2, as illustrated in the matrix 706, the dot data are allocated to the areas 1 and 7. Further, in the level 3, as illustrated in the matrix 707, the dot data are allocated to the areas 1, 3, and 7, and in the level 4, as illustrated in the matrix 708, the dot data are allocated to the areas 1, 3, 5, and 7. As described, in the matrixes 705 to 708 of the index pattern data B, in any of the levels (that is, regardless of the numbers of dots), at least one dot datum is allocated to any of the odd-numbered areas 1, 3, 5, and 7 and, therefore, the printing operation based on any of the four types of dot data is also performed in the forward scan.

A pattern data group having the above-described two types of pattern data, i.e., the index pattern data A and the index pattern data B, is referred to as an index pattern data set (dot arrangement pattern data set). Which index pattern data in the index pattern data set should be selected is determined by after-mentioned processing, and on the basis of the result of the determination, the index pattern data A or B are selected. Then, from the selected index pattern data A or B, a matrix corresponding to the pixel data is selected, in which the pixel data are expanded as printing data.

Next, data processing using the above-described index pattern data A or B is described along the data processing flow in FIGS. 6A to 6E.

As described above, the 8-bit RGB input image data 601 having been processed to have a resolution of 600 dpi are converted to the C, M, Y, Bk pixel data 602. Then, the multi-value (0 to 255) pixel data are converted to the 5-level (0 to 4) C, M, Y, Bk pixel data 603 by the quantization processing. Also, on the basis of multi-value pixel input values (0 to 255) of C, M, Y, Bk, it is determined whether the bidirectional printing or unidirectional printing should be performed as an image printing method. A method for the determination will be described later. If it is determined here that the bidirectional printing should be performed, the index pattern data A are selected, and from the index pattern data A, pattern data corresponding to the level of the pixel data are selected. For example, if the quantized pixel data level is 3, on the basis of the pattern data 703 in FIG. 7A, the pixel data are expanded. In the index pattern data A, the dot data are allocated to the areas 2, 3, 6, and 7 described in the matrix M of FIG. 6D and, therefore, the printing is performed by the forward and backward scans. On the other hand, as a result of the determination in the step 603, if it is determined that the unidirectional printing should be performed, the index pattern data B are selected, and from the index pattern data B, pattern data corresponding to the level of the pixel data are selected. For example, if the processing result in 603 corresponds to the level 3, on the basis of the pattern data 707 in FIG. 7B, the pixel pattern data are expanded.

As described, by employing the printing method that combines the printing data generating method and the printing method that performs printing on the basis of the division into multiple printing scans, a print scanning direction can be selected for each matrix (in this case, horizontally 4 areas× vertically 2 areas) formed by predetermined pixels.

Next, the method for determining which of the above-described bidirectional and unidirectional printing methods should be selected is described.

It is assumed that, in the multi-value (0 to 255) pixel data corresponding to the respective ink colors, a cyan pixel input value is denoted by Vc, magenta pixel input value by Vm, yellow pixel input value by Vy, and black pixel input value by Vk. Also, regarding weightings N of the respective inks, it is assumed that a cyan weighting is denoted by Nc, magenta weighting by Nm, yellow weighting by Ny, and black weighting by Nk. These weightings are set in consideration of the degrees contributed by the respective inks to color unevenness. Also, it is assumed that a threshold value serving as a criterion for determining which of the bidirectional and unidirectional printing methods should be employed is denoted by S.

On the other hand, given that the value (color unevenness occurrence value) calculated from the respective color pixel input values inputted in a predetermined area and the corresponding weighting coefficients is denoted by K, K is obtained by the following expression:

$$K=Nc\times Vc+Nm\times Vm+Ny\times Vy+Nk\times Vk \quad (1)$$

In the present embodiment, in consideration of contribution ratios of the respective inks to the occurrence of color unevenness on the basis of the experimental result, the weighting coefficients are set as Nc=1.3, Nm=1.0, Ny=1.5, and Nk=0.7. For example, in the case where Vc is 210, Vm is 128, Vy is 32, and Vk is 16, K calculated from the respective ink color input values and corresponding weightings is 460. If the K value obtained according to the weightings is 400 or more, it is determined that color unevenness is likely to occur and, therefore, the threshold value S is set as S=400. The value K calculated from the respective ink color pixel input values and corresponding weightings is compared with the threshold value S to determine whether the bidirectional or unidirectional printing is performed.

Among the above weighting coefficients, yellow weighting coefficient and cyan weighting coefficient are larger than the weighting coefficients of the other inks. Weighting coefficient values of yellow and cyan inks are set to be larger because yellow ink and cyan ink more affect a hue compared to the other inks (for example black ink), and more affect a change of hue due to the printing order of ink.

As described above, in the case where the value K calculated with use of the respective ink color pixel input values is smaller than the threshold value S, even if the bidirectional printing is performed, the color unevenness does not occur between the forward and backward scans. For this reason, the index pattern data A where dots are printed by the forward and backward scans are selected. On the other hand, in the case where the value K calculated with use of the respective ink color pixel input values is equal to or more than the threshold value S, if the bidirectional printing is performed, the color unevenness occurs between the forward and backward scans and, therefore, the index pattern data B where dots are printed only by the forward scan are selected. On the basis of the above procedure, index pattern data are selected to determine for each inputted pixel unit (600 dpi) whether the optimum printing method is bidirectional or unidirectional printing method, and according to a result of the determination, dots are printed.

Figure 8:
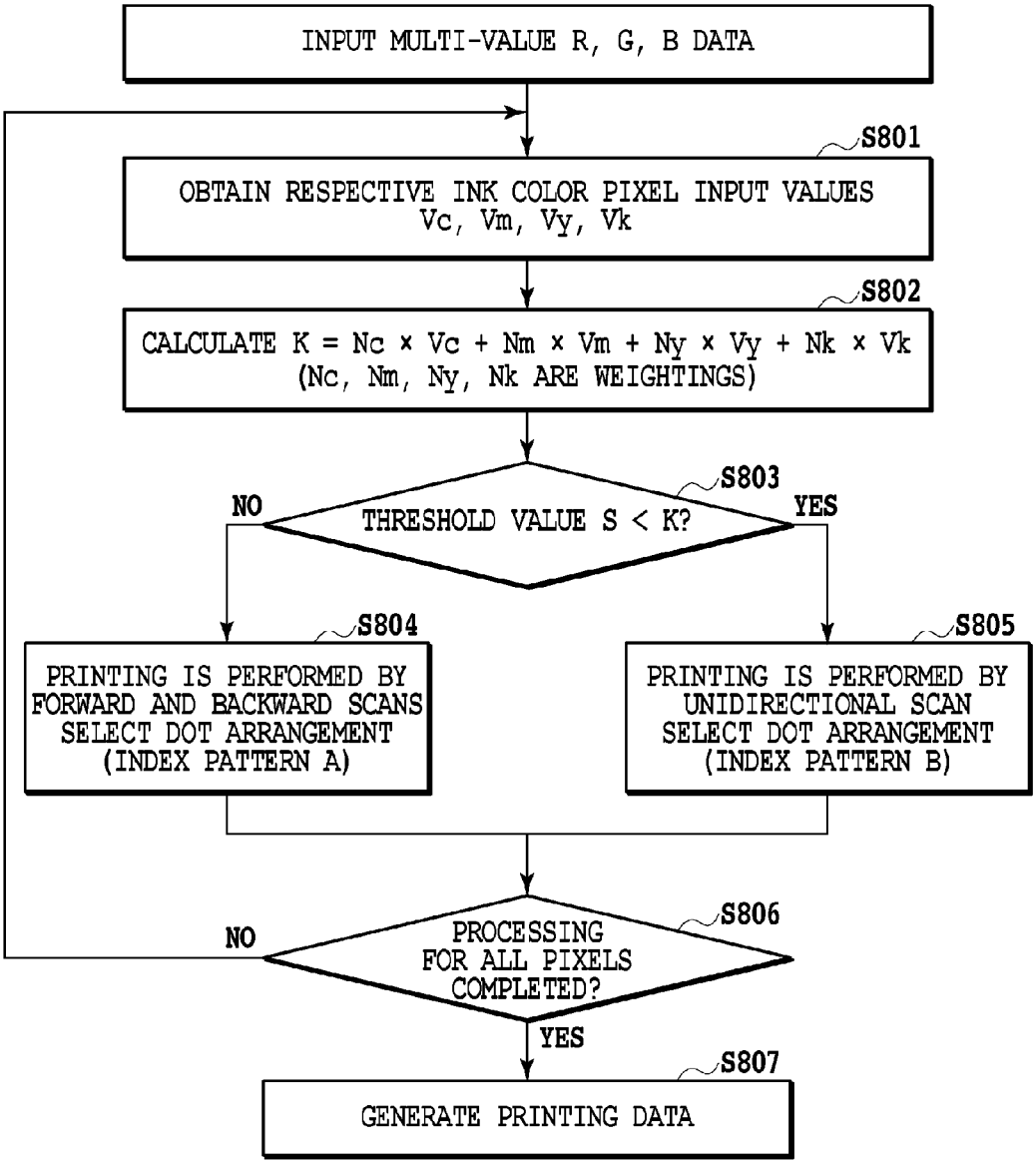
FIG. 8 is a flowchart of the printing data generation processing in the first embodiment.

FIG. 8 is a flowchart of the above printing data generation processing.

In S801, the respective ink color pixel input values Vc, Vm, Vy, and Vk are obtained. In S802, from the respective ink color pixel input values inputted in S801 and corresponding weighting coefficients, the K value is calculated. In S803, it is determined whether or not the K value calculated in S802 is equal to or more than the preset threshold values S. Here, for a pixel of which the K value is determined to be less than the threshold value (less than S), the index pattern data A for which printing is performed by the forward and backward scans are selected (S804). On the other hand, for a pixel of which the K value is determined in S803 to exceed the threshold value S, the index pattern data B for which printing is performed only by the forward scan are selected in S805. In S806, it is determined whether or not the processing to select index pattern data is completed for all of input pixels. If not, the flow returns to S801 and the processing continues until it is determined that the processing for all of the input pixels is completed. If it is determined that the processing for all of the input pixels is completed, printing data are generated to start printing (S807).

Figures 9D, 9E:
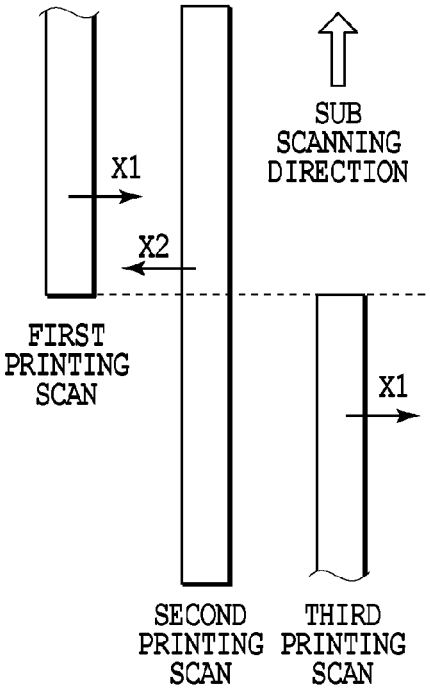

FIGS. 9A to 9E are schematic diagrams for describing data processing at the time of forming an image within a predetermined area according to the present embodiment, printing operation performed on the basis of the processed data, and the like. FIG. 9A illustrates the result of, for each type of pixel data of input image data having a size of horizontally 12 pixels and vertically 12 pixels and a resolution of 600 dpi, determining whether or not the K value calculated from pixel input values and corresponding weights on the basis of the flowchart in FIG. 8 is equal to or more than the threshold value (equal to or more than S). Here, an outline pixel represents a pixel of which the K value is determined to be less than the threshold value S. On the other hand, a pixel filled with black represents a pixel of which the K value is determined to be equal to or more than the threshold value S.

Also, FIG. 9B illustrates index pattern data selected on the basis of the results of the determinations in FIG. 9A. Pixels denoted by A in FIG. 9B represent a state where the index pattern data A are selected, whereas pixels denoted by B in FIG. 9B represent a state where the index pattern data B are selected. For the pixels for which the index pattern data A are selected, printing is performed by the forward and backward scans. Also, for the pixels for which the index pattern data B are selected, printing is performed only by the forward scan. Accordingly, for the pixels where a ○ mark is described in FIG. 9C, printing is performed in the forward and backward directions. Also, for the pixels where a X mark is described, printing is performed only in the forward direction.

FIG. 9D is a schematic diagram illustrating the operation of so-called two-pass divided printing that performs two scans to complete an image to be printed. In the two-pass divided printing, first, the printing heads are moved in the forward direction (X1 direction) to perform a first printing scan. Then, the printing medium is conveyed in the printing sub scanning direction, and then the printing heads are moved in the backward direction (X2 direction) to perform a second printing scan. Subsequently, the printing medium is conveyed in the sub scanning direction, and then the printing heads are moved in the forward direction to perform a third printing scan.

On the other hand, FIG. 9E is a schematic diagram illustrating what number of the scan in the printing operation of FIG. 9D performs printing for a pixel within an area illustrated in FIG. 9C. A numeral 1, 2, or 3 described in each of the pixels illustrated in FIG. 9E refers to the first, second, or third printing scan. That is, pixels in which the numerals 1, 2 are described are pixels for which printing is performed by the first and second printing scans, and for these pixels, printing is performed by the forward and backward scans. Also, pixels in which the numerals 2, 3 are described are pixels for which printing is performed by the second and third printing scans, and for these pixels, printing is performed also by the forward and backward scans.

On the other hand, pixels in which the numeral 1 is described are pixels for which printing is performed only by the first printing scan, and for these pixels, printing is performed only by the forward scan. Also, pixels in which the numeral 3 is described are pixels for which printing is performed only by the third printing scan, and printing is performed only by the forward scan. As described, for a pixel where it is determined that color unevenness does not occur, printing is performed by both of the forward and backward scans on the basis of the two-pass divided printing. On the other hand, for a pixel where it is determined that color unevenness occurs, printing is performed only by one scan (one-pass printing scan) in the forward direction. In this case, at the time of printing in the backward direction, an idle scan is performed, resulting in no printing. As described, in the present embodiment, by keeping the two-pass divided recording scan, for a pixel in which color unevenness occurs, performing printing by one forward scan, the printing time and the color unevenness can be suppressed from being increased and from occurring, respectively.

As described above, in the first embodiment, on the inputted pixel data basis, it is determined whether or not color unevenness occurs between the forward printing and the backward printing, and in the area where the color unevenness occurs, the index pattern data for which the number of printing scans is halved and printing is performed only by the forward scan are selected. Based on this, the print scanning direction at the time of printing for each pixel can be controlled, so that the color unevenness between the forward scan printing and the backward scan printing can be suppressed, and printing that prevents printing time from being increased can be performed.

Second Embodiment

Next, the second embodiment of the present invention is described. In addition, it is assumed that the second embodiment is also provided with the configuration illustrated in FIGS. 1 to 3.

In the second embodiment, a plurality of index pattern data sets are used to select a printing direction for each unit area and suppress color unevenness from occurring. That is, in the above first embodiment, one type of index pattern data set including the index pattern data A and the index pattern data B is used to select index pattern data for every individual pixel. On the other hand, in the second embodiment, by using the plurality of index pattern data sets, dispersibility of printing data is improved to suppress a texture from occurring.

The procedure for data processing on the basis of the pixel data is the same as that in the above-described first embodiment. FIGS. 10A to 10E are diagrams schematically illustrating a plurality of index pattern data sets in the second embodiment, and an example of an index allocation pattern that defines allocations of index pattern data to respective printing pixels. In the above first embodiment, the index pattern data A for which printing is performed by the forward and backward scans, or the index pattern data B for which printing is performed only in one direction are selectively used for the printing pixel. On the other hand, in the second embodiment, from the plurality of index pattern data sets as illustrated in FIGS. 10A to 10D, an index pattern data set corresponding to the position of the printing pixel is selected. In the present embodiment, the four types of index pattern data sets illustrated in FIGS. 10A to 10D are used to provide the description.

Figures 10A, 10B:
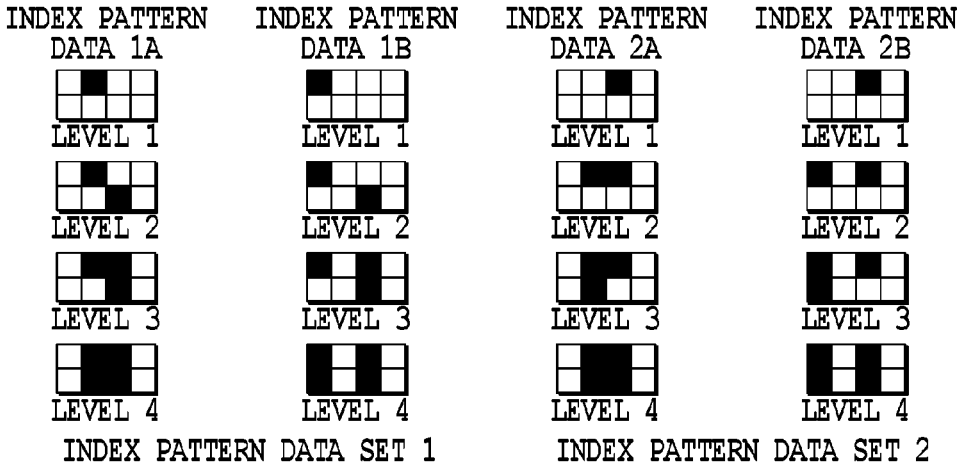
FIGS. 10A to 10D are diagrams schematically illustrating index pattern data sets in the second embodiment.
Figures 10C, 10D:
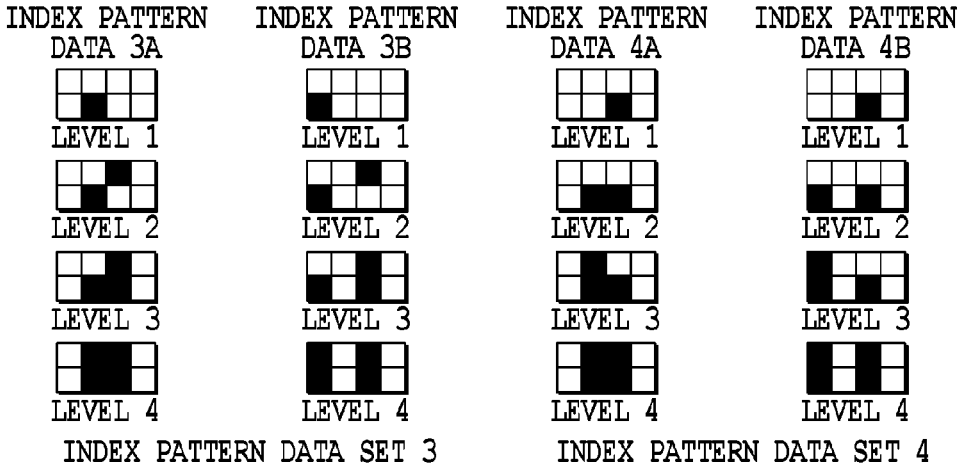

FIG. 10A illustrates an index pattern data set 1. The index pattern data set 1 is configured to have index pattern data 1A for which printing is performed by the forward and backward scans and index pattern data 1B for which printing is performed only in one direction. Also, FIGS. 10B, 10C, and 10D illustrate index pattern data set 2, index pattern data set 3, and index pattern data set 4, respectively. These index pattern data sets also have index pattern data 2A, 3A, and 4A for which printing is performed by the forward and backward scans and index pattern data 2B, 3B, and 4B for which printing is performed only in one direction.

Figure 10E:
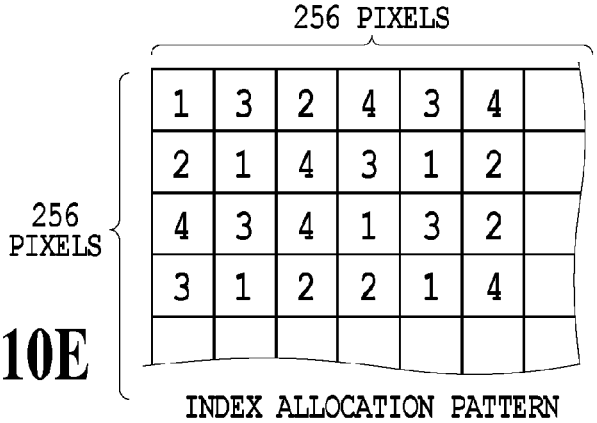
FIG. 10E is a diagram schematically illustrating an example of an allocation pattern of index pattern data in the second embodiment.

FIG. 10E illustrates index allocation pattern data that are used to select (first selection step) an index pattern data set. In the second embodiment, the index allocation pattern data having a size of horizontally 256 pixels and vertically 256 pixels are repeatedly used. Depending on the inputted pixel position, from the index allocation pattern data, any of the above-described four types of index pattern data sets is selected. If within FIG. 10E, in the pixel position denoted by 1, printing data are present, the index pattern data set 1 is selected. Similarly, if in the pixel position denoted by 2, printing data are present, the index pattern data set 2 is selected, and if in the pixel position denoted by 3, printing data are present, the index pattern data set 3 is selected. Further, if in the pixel position denoted by 4, printing data are present, the index pattern data set 4 is selected.

Also, it is determined which of the index pattern data for performing bidirectional printing and index pattern data for performing unidirectional printing is selected from a pair of index pattern data in each of the index pattern data sets. This determination is made with use of, as in the above first embodiment, pixel input values, corresponding weighting coefficients, and the above expression 1.

The printing data generation processing using the above index pattern data selection method is described by, as an example, citing a pixel position where the index pattern data set 1 is selected. First, depending on the inputted pixel position in the above-described index allocation pattern data, from the above-described four types of index pattern data sets, the index pattern data set 1 is selected. Then, on the basis of the result of the above-described determination whether the bidirectional or unidirectional printing is performed, the index pattern data 1A or index pattern data 1B are selected (second selection step), and on the basis of the selected index pattern data, pixel data are expanded.

Figure 11:
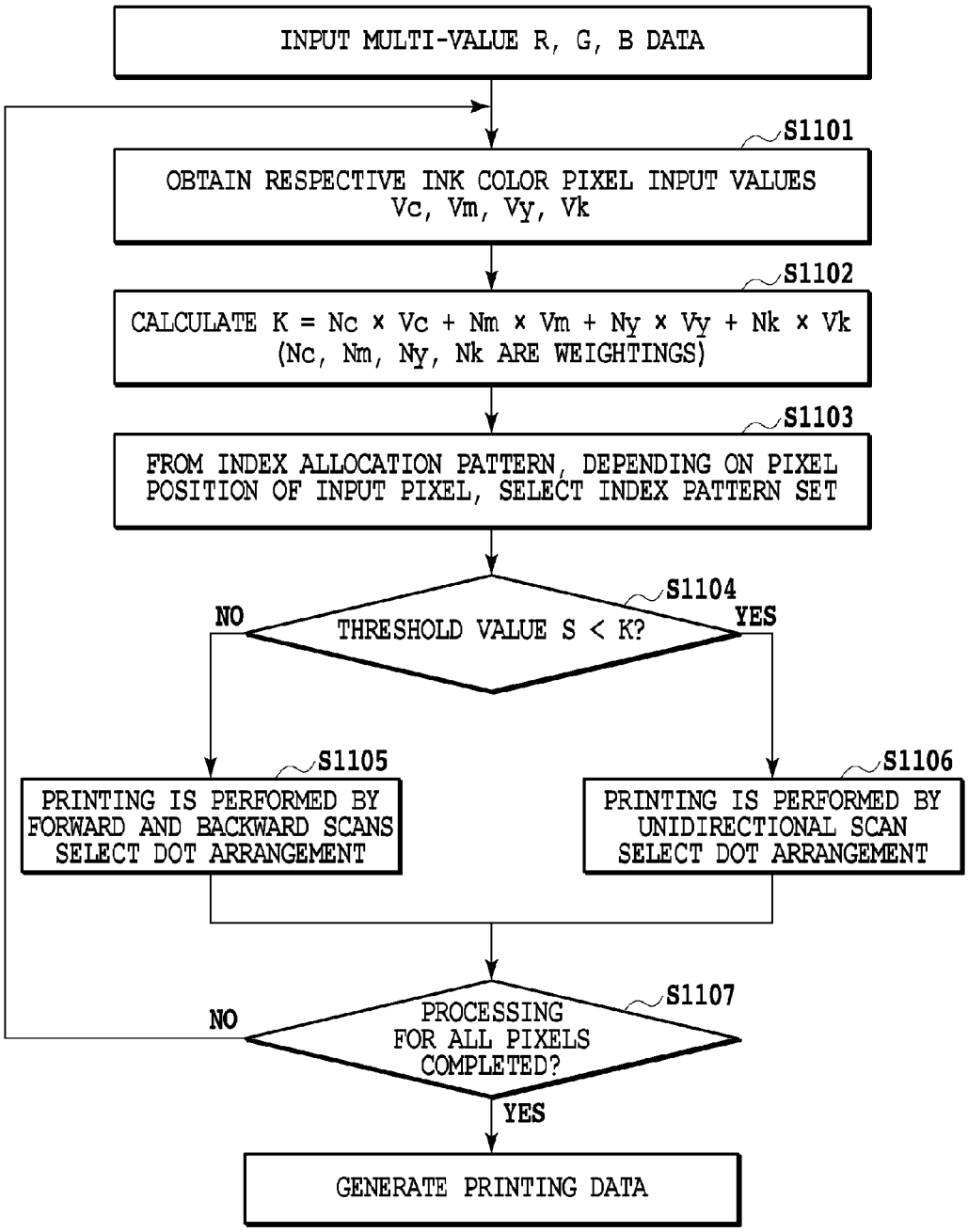
FIG. 11 is a flowchart of printing data generation processing according to the second embodiment.

FIG. 11 is a flowchart of the printing data generation processing in the second embodiment. In S1101, Vc, Vm, Vy, and Vk that are respective ink color pixel input values are obtained. In S1102, on the basis of the respective ink color pixel input values inputted in S1101, a K value is calculated from ink amounts and corresponding weighting coefficients. In S1103, it is determined whether or not the K value calculated in S1102 is equal to or more than a preset threshold value S. Then, in S1103, the index allocation pattern data illustrated in FIG. 10E are referenced to select an index pattern data set corresponding to a pixel position in the printing data.

Here, a pixel for which the index pattern data set 1 is selected in S1103 is cited as an example of the description. For a pixel of which the K value is determined in S1104 to be less than the threshold S, because the index pattern data set 1 is selected in S1103, the index pattern data 1A for which printing is performed by the forward and backward scans are selected in S1105. On the other hand, for a pixel of which the K value is determined in S1104 to be equal to or more than the threshold value S, because the index pattern data set 1 is selected in S1103, the index pattern data 1B for which printing is performed only by the forward scan are selected in S1106. In S1107, it is determined whether or not for all of the input pixels, the index pattern data selection processing is completed. If not, the flow returns to S1101, and the processing is repeated until it is determined that the processing for all of the input pixels is completed. Then, if it is determined that for all of the input pixels, the index pattern data selection processing is completed, printing data are generated to start printing.

Figures 12E, 12F:
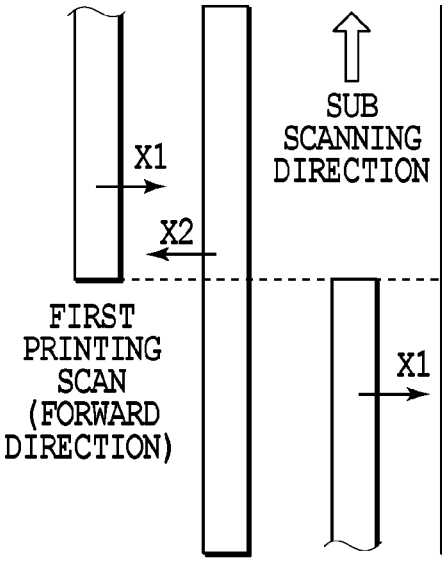

FIGS. 12A to 12F are schematic diagrams for describing data processing at the time of forming an image within a predetermined area according to the second embodiment, printing operation performed on the basis of the processed data, and the like. FIG. 12A illustrates the result of, for each type of pixel data in input image data having a size of horizontally 12 pixels and vertically 12 pixels and a resolution of 600 dpi, determining whether or not the K value calculated from pixel input values and corresponding weighting coefficients on the basis of the flowchart in FIG. 11 is equal to or more than the threshold value S. Here, an outline pixel represents a pixel of which the K value is determined to be less than the threshold value S. On the other hand, a pixel filled with black represents a pixel of which the K value is determined to be equal to or more than the threshold value S.

Also, FIG. 12B is a schematic diagram of the index allocation pattern data for selecting an index pattern data set corresponding to each pixel position of an image having a size of vertically 12 pixels and horizontally 12 pixels. FIG. 12C illustrates index pattern data that are finally allocated to each pixel on the basis of the result of the determination in FIG. 12A, and an index pattern data set selected from the index allocation pattern data illustrated in FIG. 12B. For pixels denoted by 1A, 2A, 3A, and 4A in FIG. 12C, the index pattern data 1A, index pattern data 2A, index pattern data 3A, and index pattern data 4A are respectively selected. On the other hand, for pixels denoted by 1B, 2B, 3B, and 4B in FIG. 12C, the index pattern data 1B, index pattern data 2B, index pattern data 3B, and index pattern data 4B are respectively selected.

FIG. 12D illustrates the scanning direction at the time of performing printing in each pixel, and as is clear from the diagram, for the pixels for which 1A, 2A, 3A, or 4A is selected in FIG. 12C, printing is performed by the forward and backward scans. Also, for the pixels for which 1B, 2B, 3B, or 4B is selected in FIG. 12C, printing is performed only by the forward scan. Accordingly, for the pixels where a ○ mark is described in FIG. 12D, printing is performed in the forward and backward directions. Also, for the pixels where a X mark is described, printing is performed only in the forward direction.

FIG. 12E is a schematic diagram illustrating operation of so-called two-pass divided printing that performs two scans to complete an image to be printed, and the basic operation of the two-pass divided printing is the same as that in the above first embodiment. Also, FIG. 12F is a schematic diagram illustrating what number of the scan in the printing operation of FIG. 12E performs printing for a pixel within an area illustrated in FIG. 12E. A numeral 1, 2, or 3 described in each of the illustrated pixels refers to the first, second, or third printing scan. That is, pixels in which the numerals 1, 2 are described are pixels for which printing is performed by the first and second printing scans, and for these pixels, printing is performed by the forward and backward scans. Also, pixels in which the numerals 2, 3 are described are pixels for which printing is performed by the second and third printing scans, and for these pixels, printing is performed also by the forward and backward scans.

On the other hand, pixels in which the numeral 1 is described are pixels for which printing is performed only by the first printing scan and, therefore, printing is performed only by the forward scan. Also, pixels in which the numeral 3 is described are pixels for which printing is performed only by the third printing scan, and printing is performed only by the forward scan. As described, for a pixel where it is determined that color unevenness does not occur, printing is performed by both of the forward and backward scans on the basis of the two-pass divided printing. On the other hand, for a pixel where it is determined that color unevenness occurs, printing is performed only by one printing scan (one-pass printing scan) in the forward direction. In this case, at the time of printing in the backward direction, an idle scan is performed, resulting in no printing. As described, even in the second embodiment, by keeping the two-pass divided printing scan and performing printing by one forward scan, the printing time and color unevenness can be suppressed from being increased and from occurring, respectively.

As described above, even in the second embodiment, on the basis of the inputted pixel data, it is determined whether or not color unevenness is likely to occur between the forward printing time and the backward printing time, and in an area where the color unevenness is likely to occur, the number of printing scans is halved and printing is performed only by the forward scan. Accordingly, even in the second embodiment, the print scanning direction at the time of printing for each pixel can be controlled, so that the color unevenness at the time of printing caused by performing the forward and backward scans and an increase in printing time can be suppressed. Further, according to the second embodiment, dispersibility of printing data can be increased to more dispersion of the print scanning direction, so that a texture can be suppressed from occurring to thereby form higher quality images.

Other Embodiments

In each of the above embodiments, the inkjet printer has the function of a data processor of the present invention, and performs the processing that combines the binarization processing using the dot arrangement pattern data (index pattern data) and the printing method using the column thinning method. However, the present invention is not limited to this. For example, the inkjet printer may be configured such that printing data can be distributed in the forward and backward directions, and in a predetermined area, the printing data can be set.

Also, the above embodiment is configured such that the color unevenness occurrence value is calculated on the basis of the values of respective ink color pixel data and weighting coefficients, and on the basis of the calculated color unevenness occurrence value, index pattern data are selected. However, the unit area serving as a unit based on which the color unevenness occurrence value is calculated is not set as one pixel, but may be set as an area including a plurality of pixels, and the color unevenness occurrence value may be calculated for each unit area including the plurality of pixels. In this case, index pattern data used for the plurality of pixels within the unit area are selected on the basis of a sum of multiplication values obtained by multiplying pixel data for the respective ink colors corresponding to the unit area by weighting coefficients determined for the respective ink colors. That is, printing data for each of the pixels located in the unit area are determined by using the same index pattern data.

Further, the present invention can also be achieved even by a program code realizing a procedure of the flowchart that utilizes a function of each of the above-described embodiments which are illustrated in FIG. 8 or 11, with the program code being stored in a storage medium. The present invention is also realized in a way that even a computer (or CPU or MPU) of a system or printer can read and execute the program code stored in the storage medium. In this case, the program code itself read from the storage medium realizes the function of each of the above-described embodiments, and the storage medium storing the program code constitutes the present invention.

Also, the "printing medium" is not limited to paper used in a typical print, but includes a wide variety of substances that can accept ink, such as cloth, plastic film, metal plate, glass, ceramic, wood, or leather.

Further, the "ink" shall be widely interpreted as in the definition of the above "printing". That is, the "ink" used in the present embodiment is defined as representing liquid that is provided on the printing medium, and can be thereby used to form an image, design, pattern, or the like, fabricate the printing medium, or process the ink (e.g., solidification or insolubilization of a coloring material in the ink provided to the printing medium).

Further, the "nozzle" is, unless otherwise noted, defined as collectively referring to an ejection port or a liquid path communicatively connected to the ejecting port, and a device that generates energy used for ink ejection.

Also, in the present invention, a system that uses the electrothermal transducer to eject ink is described; however, a system that uses an electromechanical transducer to eject ink can also be employed.

Also, the present embodiment is configured such that the width size of the printing medium is detected with use of the optical sensor, and corresponding detection data are inputted to the CPU serving as the control unit; however, the width size of the printing medium may be preliminarily inputted to the CPU by a user through an input unit.

In addition, the inkjet printer according to the present invention may be one that, in addition to a printer that is integrally or separately provided as an image output terminal of an information processor such as a computer, has the configuration of a copier combined with a reader and the like, or a facsimile machine having a transmission/reception function.

In addition, the present invention includes the case where a software program achieving function processing of each of the above-described embodiments is directly or remotely supplied to the system or printer, and the computer of the system or printer reads and executes the supplied program code. In this case, in order to achieve the function processing of the present invention with the computer, the program code itself installed in the computer also realizes the present invention. Also, the program installed in the computer is only required to achieve the function processing of the present invention, and may have any kind of program form, such as an object code, program executed by an interpreter, or script data supplied to an OS.

Besides, as a method for supplying the program, the program can also be supplied by using the browser of a client computer to make a connection to the Internet and downloading from a homepage, the program itself of the present invention or a file including the compressed program and an automatic installation function. Also, the program can be supplied by dividing the program code constituting the program of the present invention into a plurality of files, and downloading the respective files from different homepages. That is, a WWW server that instructs a plurality of users to download the program file for achieving the function processing of the present invention with a computer is also included in the scope of the present invention.

Also, in addition to executing the program read by the computer to achieve the function of each of the above-described embodiments, the function of each of the above-described embodiments can also be achieved by processing one part or all the parts actually performed by the OS or the like by running the program on the computer.

The present invention can be applied to all equipment using the above-described printing medium. Specific applicable equipment includes office equipment such as a printer, copier, and facsimile, industrial production equipment, and the like. Also, the present invention is particularly effective for equipment that performs high-speed printing on a large-sized printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-160998, filed Jul. 15, 2010, which is hereby incorporated by reference herein in its entirety.

What is claimed is:

1. An inkjet printer comprising:

a printing unit capable of ejecting inks of different colors to print an image on a unit area of a printing medium, by moving the printing unit in predetermined backward and forward scanning directions over the unit area, on a basis of printing data specifying ejection or non-ejection of the inks;

a printing data generation unit that generates the printing data corresponding to each of the inks on a basis of unit image data corresponding to each of the inks, having a value representing an amount of ink, corresponding to an image to be formed on the unit area; and a determination unit that determines a color unevenness occurrence value relating to a degree of occurrence of color unevenness on the basis of i) the values of the unit image data corresponding to each of the inks and ii) predetermined weightings for each of the inks, wherein if the color unevenness occurrence value is less than a threshold value, the printing data generation unit enables a dot to be formed in the unit area by a forward scan and a backward scan of the printing unit, whereas if the color unevenness occurrence value is more than the threshold value, the printing data generation unit enables a dot to be formed in the unit area only by one of the forward scan and the backward scan of the printing unit.

2. The inkjet printer according to claim 1, wherein the printing data generation unit comprises:

first dot arrangement pattern data that are, corresponding to the values of the unit image data, provided with a plurality of types of pattern data that enable a pattern including a dot to be formed in the unit area to be printed by the forward scan and the backward scan of the printing heads;

second dot arrangement pattern data that are, corresponding to the values of the unit image data, provided with a plurality of types of pattern data that enable a pattern including a dot to be formed in the unit area to be printed only in a predetermined one-way movement of the forward scan and the backward scan of the printing heads, the pattern being printed in the predetermined one-way movement regardless of the number of the dots to be formed in the unit; and a selection unit that, if the color unevenness occurrence value is more than the threshold value, selects the second dot arrangement pattern data, and if the color unevenness occurrence value is less than the threshold value, selects the first dot arrangement pattern data, wherein among a plurality of types of pattern data constituting dot arrangement pattern data selected by the selection unit, pattern data corresponding to the values of the unit image data are set as the printing data on the unit image.

3. The inkjet printer according to claim 1, wherein the printing data generation unit comprises:

a plurality of dot arrangement pattern data sets including first dot arrangement pattern data that are, corresponding to the values of the image data, provided with a plurality of types of pattern data that enable a pattern to be printed by the forward scan and the backward scan of the printing unit, the pattern including a dot to be formed in the unit area, and second dot arrangement pattern data that are, corresponding to the values of the image data, provided with a plurality of types of pattern data that enable a pattern to be printed only in a predetermined one-way movement of the forward scan and the backward scan of the printing unit, the pattern including a dot to be formed in the unit area;

a first selection unit that, corresponding to the position of the unit area in the image to be printed, selects a predetermined dot arrangement pattern data set among the dot arrangement pattern data sets; and a second selection unit that, if the color unevenness occurrence value is more than the threshold value, from the dot arrangement pattern data set selected by the first selection unit, selects the second dot arrangement pattern data, and if the color unevenness occurrence value is less than the threshold value, from the dot arrangement pattern data set selected by the first selection unit, selects the first dot arrangement pattern data, wherein pattern data corresponding to the values of the unit image data are set as the printing data on the unit image.

4. The inkjet printer according to claim 1, wherein the color unevenness occurrence value is the sum of a plurality of multiplication values obtained by multiplying the values of unit image data corresponding to the plurality of ink colors by weighting coefficients determined for the respective ink colors.

5. The inkjet printer according to claim 1, wherein the unit area is a pixel, and the unit image data are data that form a dot in the pixel.

6. The inkjet printer according to claim 1, wherein the printing unit performs printing on the unit area by performing a predetermined number of scans over the unit print area, if the color unevenness occurrence value is less than the threshold value, the printing data generation unit enables a dot to be formed in the unit area by a forward scan and a backward scan in the predetermined number of scans of the printing unit, whereas if the color unevenness occurrence value is more than the threshold value, the printing data generation unit enables a dot to be formed in the unit area only by one of the forward scan and the backward scan in the predetermined number of scans of the printing unit.

7. An inkjet printing method for printing on a printing medium by moving a printing unit capable of ejecting inks of different colors in predetermined backward and forward scanning directions and on the basis of printing data specifying ejection or non-ejection of the inks, and controlling ejection of the inks from the printing unit to print an image on a printing medium, the inkjet printing method comprising:

a printing data generation step of generating the printing data corresponding to each of the inks on the basis of unit image data corresponding to each of the inks, having a value representing an amount of ink, corresponding to an image to be formed on the unit area; and a determination step of determining a color unevenness occurrence value relating to a degree of occurrence of color unevenness on the basis of i) the values of the unit image data corresponding to each of the inks and ii) predetermined weightings for each of the inks, wherein if the color unevenness occurrence value is less than a threshold value, the printing data generation step enables a dot to be formed in the unit area by a forward scan and a backward scan of the printing unit, whereas if the color unevenness occurrence value is more than the threshold value, the printing data generation step enables a dot to be formed in the unit area only by one of the forward scan and the backward scan of the printing unit.

8. The inkjet printing method according to claim 7, wherein the printing data generation step comprises:

a first preparing step that prepares first dot arrangement pattern data that are, corresponding to the values of the unit image data, provided with a plurality of types of pattern data that enable a pattern including a dot to be formed in the unit area to be printed by the forward scan and the backward scan of the printing unit;

a second preparing step that prepares second dot arrangement pattern data that are, corresponding to the values of the unit image data, provided with a plurality of types of pattern data that enable a pattern including a dot to be formed in the unit area to be printed only in a predetermined one-way movement of the forward scan and the backward scan of the printing heads, the pattern being printed in the predetermined one-way movement regardless of the number of the dots to be formed in the unit area; and a selection step that, if the color unevenness occurrence value is more than the threshold value, selects the second dot arrangement pattern data, and if the color unevenness occurrence value is less than the threshold value, selects the first dot arrangement pattern data, wherein among a plurality of types of pattern data constituting dot arrangement pattern data selected in the selection step, pattern data corresponding to the values of the unit image data are set as the printing data on the unit image.

9. The inkjet printing method according to claim 7, wherein the printing data generation step comprises:

a preparing step that prepares a plurality of dot arrangement pattern data sets including first dot arrangement pattern data that are, corresponding to the values of the image data, provided with a plurality of types of pattern data that enable a pattern to be printed by the forward scan and the backward scan of the printing unit, the pattern including a dot to be formed in the unit area, and second dot arrangement pattern data that are, corresponding to the values of the image data, provided with a plurality of types of pattern data that enable a pattern to be printed only in a predetermined one-way movement of the forward scan and the backward scan of the printing unit, the pattern including a dot to be formed in the unit area;

a first selection step that, corresponding to the position of the unit area in the image to be printed, selects a predetermined dot arrangement pattern data set among the dot arrangement pattern data sets; and a second selection step that, if the color unevenness occurrence value is more than the threshold value, from the dot arrangement pattern data set selected in the first selection step, selects the second dot arrangement pattern data, and if the color unevenness occurrence value is less than the threshold value, from the dot arrangement pattern data set selected in the first selection step, selects the first dot arrangement pattern data, wherein pattern data corresponding to the values of the unit image data are set as the printing data on the unit image.

10. The inkjet printing method according to claim 7, wherein the color unevenness occurrence value is the sum of a plurality of multiplication values obtained by multiplying the values of unit image data corresponding to the plurality of ink colors by weighting coefficients determined for the respective ink colors.

11. The inkjet printing method according to claim 7, wherein the unit area is a pixel, and the unit image data are data that form a dot in the pixel.

12. The inkjet printing method according to claim 7, wherein the printing unit performs printing on the unit area by performing a predetermined number of scans over the unit area, wherein if the color unevenness occurrence value is less than the threshold value, the printing data generation step enables a dot to be formed in the unit area by a forward scan and a backward scan in the predetermined number of scans of the printing unit, whereas if the color unevenness occurrence value is more than the threshold value, the printing data generation step enables a dot to be formed in the unit area only by one of the forward scan and the backward scan in the predetermined number of scans of the printing unit.

* * * * *